US009387675B2

(12) United States Patent
Watanabe et al.

(10) Patent No.: US 9,387,675 B2
(45) Date of Patent: Jul. 12, 2016

(54) LIQUID DISCHARGE HEAD

(71) Applicant: CANON KABUSHIKI KAISHA, Tokyo (JP)

(72) Inventors: Makoto Watanabe, Yokohama (JP); Keiji Watanabe, Kawasaki (JP); Shuhei Oya, Kawasaki (JP); Shingo Nagata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,924

(22) Filed: May 26, 2015

(65) Prior Publication Data

US 2015/0343780 A1 Dec. 3, 2015

(30) Foreign Application Priority Data

May 29, 2014 (JP) ..... 2014-111647

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/1429* (2013.01); *B41J 2/1412* (2013.01); *B41J 2/14016* (2013.01); *B41J 2/1601* (2013.01); *B41J 2/1603* (2013.01); *B41J 2/1642* (2013.01); *B41J 2/1645* (2013.01); *B41J 2/1408* (2013.01); *B41J 2/14088* (2013.01); *B41J 2202/03* (2013.01)

(58) Field of Classification Search

CPC ... B41J 2/1408; B41J 2/14088; B41J 2/14016
See application file for complete search history.

(56) References Cited

U.S. PATENT DOCUMENTS

| | | | | |
|---|---|---|---|---|
| 5,706,041 | A * | 1/1998 | Kubby | B41J 2/1412 347/18 |
| 2008/0136868 | A1 * | 6/2008 | Lebens | B41J 2/1404 347/47 |
| 2014/0368581 | A1 * | 12/2014 | Takahashi | B41J 2/14129 347/64 |

FOREIGN PATENT DOCUMENTS

| | | |
|---|---|---|
| JP | 2010-120389 A | 6/2010 |

* cited by examiner

*Primary Examiner* — Geoffrey Mruk
(74) *Attorney, Agent, or Firm* — Canon U.S.A. Inc., IP Division

(57) ABSTRACT

A liquid discharge head includes a substrate, a heat resistor layer, and a side wall member that forms a side wall of a pressure chamber. The heat resistor layer has a heat effect portion configured to foam liquid in an interior of the pressure chamber to discharge liquid from a discharge port. The heat effect portion is apart from the substrate, at least part of a surface of the heat resistor layer is covered with a covering layer in the interior of the pressure chamber, and the covering layer extends from the interior of the pressure chamber to a position coming into contact with the side wall of the side wall member.

20 Claims, 6 Drawing Sheets

LIQUID DISCHARGE HEAD

BACKGROUND OF THE INVENTION

1. Field of the Invention

This disclosure relates to a liquid discharge head.

2. Description of the Related Art

Examples of known liquid discharge heads used in an inkjet type recording apparatus include a liquid discharge head having a substrate and a heat resistor layer on the substrate. The liquid discharge head having the heat resistor layer generates air bubbles in liquid in a pressure chamber by heating a heat effect portion of the heat resistor layer and discharge liquid from a discharge port.

Japanese Patent Laid-Open No. 2010-120389 discloses a liquid discharge head having the heat effect portion of a heat generating resistor formed at a position apart from the substrate. Energy generating at the heat effect portion is sufficiently transferred to liquid in a pressure chamber by forming the heat effect portion at the position away from the substrate. A schematic drawing of the liquid discharge head as described above is illustrated in FIG. 2A. A wiring 2 is formed on a substrate 1, and an insulation layer 3 and a heat resistor layer 5 are formed thereon. A portion of the heat resistor layer 5 located in in a pressure chamber 11 corresponds to a heat effect portion. The heat effect portion is formed in a hollow shape and located at a position away from the substrate 1 in the pressure chamber 11. A side wall of the pressure chamber 11 is formed of a side wall member 7. In FIG. 2A, a discharge port 10 is also formed in the side wall member 7. The discharge port 10 is positioned above the heat effect portion of the heat resistor layer 5. A surface of the side wall member 7 where the discharge port 10 opens is covers with a surface protecting layer 9. The side wall member 7 is formed of a film of an inorganic material, and a space formed between the side wall member 7 and the substrate 1 is filled with a filling material 6.

A side wall member of the liquid discharge head described in Japanese Patent Laid-Open No. 2010-120389 is formed of an inorganic material. When the side wall member is formed of the inorganic material, the resistance characteristics of the side wall member against liquid may be improved. In addition, a reduction of the thickness of the side wall member is easily achieved.

SUMMARY OF THE INVENTION

This disclosure provides a liquid discharge head including a substrate, a heat resistor layer, and a side wall member that forms a side wall of a pressure chamber. The heat resistor layer has a heat effect portion configured to foam liquid in an interior of the pressure chamber to discharge liquid from a discharge port. The heat effect portion is apart from the substrate, at least part of a surface of the heat resistor layer is covered with a covering layer in the interior of the pressure chamber, and the covering layer extends from the interior of the pressure chamber to a position coming into contact with the side wall of the side wall member.

Further features of the present invention will become apparent from the following description of exemplary embodiments with reference to the attached drawings.

DESCRIPTION OF THE EMBODIMENTS

According to a study of the present inventors, when a side wall member is formed of an inorganic material, contact between the side wall member and a heat resistor layer may become insufficient in the liquid discharge head disclosed in Japanese Patent Laid-Open No. 2010-120389. In particular, if a heat effect portion of the heat resistor layer is positioned apart from a substrate, contact may occur easily between the side wall member and the heat resistor layer at a step portion of the heat resistor layer. At this time, if adhesiveness between the side wall member and the heat resistor layer is low, separation occurs therebetween, and discharge of liquid may be affected.

In view of such problems, it is an object of this disclosure to suppress separation of a side wall member which forms a side wall of a pressure chamber of a liquid discharge head in which a heat effect portion of a heat generating resistor is separated from a substrate.

Figure 1A:
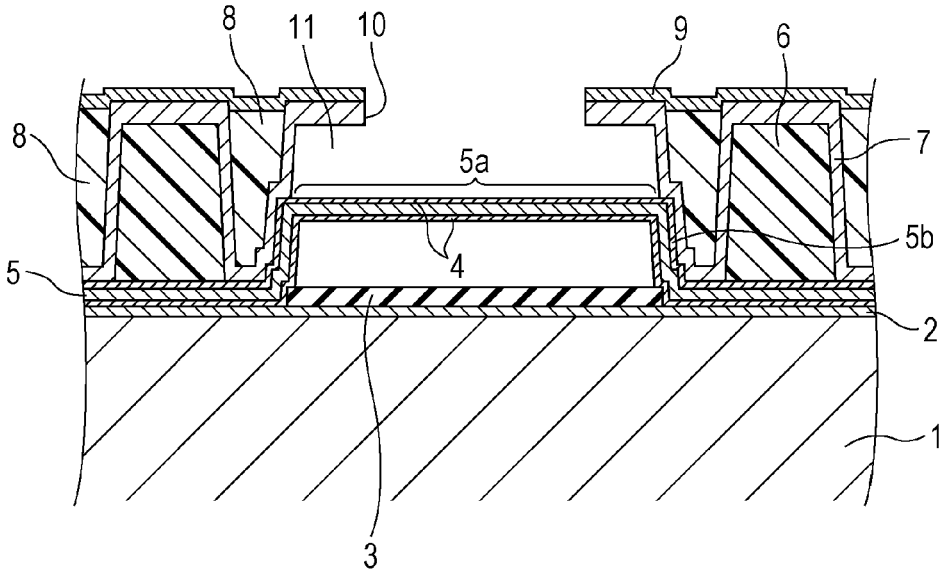
FIGS. 1A and 1B are drawings illustrating an example of a liquid discharge head of this disclosure.
Figure 1B:
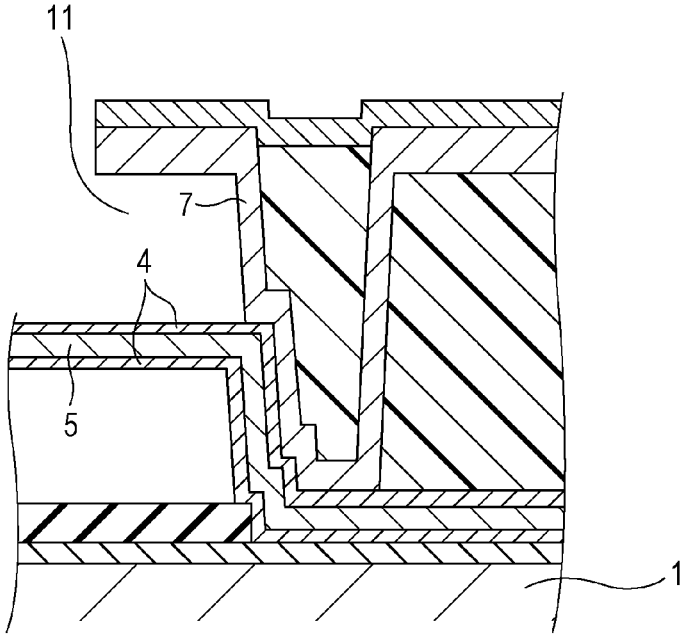

FIGS. 1A and 1B are drawings illustrating an example of a liquid discharge head of this disclosure. The liquid discharge head illustrated in FIGS. 1A and 1B includes a substrate 1. Examples of the substrate 1 include a silicon substrate formed of silicon. Wiring 2 formed of aluminum is provided on a surface of the substrate 1. When the substrate 1 is the silicon substrate, the surface on which the wiring 2 is formed is preferably (100) surface. The thickness of the wiring 2 preferably falls within a range from 0.4 μm to 1.5 μm.

An insulation layer such as $SiO_2$ and SiN may be formed between the surface of the substrate 1 and the wiring 2. In FIGS. 1A and 1B, an insulation layer 3 is formed also on an upper surface side of the wiring 2. The insulation layer 3 may be formed of multiple layers. Alternatively, wiring may be formed in multiple layers under the insulation layer 3.

A heat resistor layer 5 is provided on the surface of the wiring 2. The heat resistor layer 5 extends along the surface of the substrate 1. However, the heat resistor layer 5 is formed at a position apart from the substrate 1 in a portion in the interior of a pressure chamber 11. In other words, the heat resistor layer 5 is formed partly in a hollow shape with respect to the substrate 1. A portion which is not hollow is in contact with the surface of the substrate 1 (or the surface of the wiring 2), and is supported by the substrate 1. Air bubbles are generated in liquid in part of the heat resistor layer 5 formed into a hollow shape with respect to the substrate 1 by the heat resistor layer 5 generating heat. This part of the heat resistor layer 5 is referred to as a heat effect portion 5*a*. The heat resistor layer 5 is formed, for example, of TaN, TaSiN, TaAl, $HfB_2$, TiAl, TiAlN. The thickness of the heat resistor layer 5 preferably falls within a range from 0.1 μm to 1.0 μm. More preferably, the thickness of the heat resistor layer 5 is 0.2 μm or larger. The thickness of the heat resistor layer 5 falls within 0.8 μm or smaller. Preferably, the heat resistor layer 5 has substantially the same thickness at a portion in contact with the substrate 1 and a portion apart from the substrate 1 (the heat effect portion 5*a*) so as to have a difference within 0.1 μm. A heat resistor layer may include a plurality of layers. Examples of the layer include the layers formed of the materials described above, and, for example, a multicrystal column-shaped crystal layer.

An area of the liquid discharge head including the heat effect portion 5*a* is referred to as the pressure chamber 11.

Liquid is present in the interior of the pressure chamber 11. If the heat effect portion 5*a* of the heat resistor layer 5 is heated, the liquid in the interior of the pressure chamber 11 is heated, and hence the liquid foams in the interior of the pressure chamber 11. By utilizing the foam formation, the liquid is discharged from a discharge port 10 so as to land on a recording medium such as paper. Recording of the image or the like is performed in this manner.

The side wall of the pressure chamber 11 is formed of a side wall member 7. The side wall member 7 is formed of SiC, SiN, SiCN, $SiO_2$, Oxynitride and the like. The thickness of the side wall member 7 preferably falls within a range from 1.0 μm to 5.0 μm, and more preferably, 2.0 μm or larger. The thickness of the side wall member 7 falls within 3.0 μm or smaller.

In FIGS. 1A and 1B, the side wall member 7 forms the side wall of the pressure chamber 11, and extends therefrom up to a surface where the discharge port 10 opens (opening surface), which is an upper wall of the pressure chamber. The thickness of the portion which forms the opening surface preferably has the same thickness as that of the side wall member 7. In the case where the side wall and the portion which forms the opening surface are formed at once by CVD or the like, the thicknesses of these members are equal.

The opening surface is covered with a surface protecting layer 9. The surface protecting layer 9 is formed, for example, of SiC, SiN, SiCN, $SiO_2$, Oxynitride and the like. The thickness of the surface protecting layer 9 preferably falls within a range from 1.0 μm to 5.0 μm, and more preferably, 2.0 μm or smaller.

In FIGS. 1A and 1B, the side wall member 7 extends not only to the wall side of the pressure chamber and the opening surface of the discharge port 10, but also to the outside of the pressure chamber 11. The portion between the side wall member 7 and the substrate 1 includes a portion filled with a filling material 6. Examples of the filling material 6 include resin. If an area between the pressure chamber 11 and a portion filled with the filling material 6 and an area outside the portion filled with the filling material 6 is remained to be a space, the strength of the liquid discharge head may be lowered. Therefore, it is preferable to fill these portions with a filling material 8. Examples of the filling material 8 include resin. Examples of the resin as the filling material 6 and the filling material 8 include novolak resin, for example.

In the interior of the pressure chamber 11, the length from the heat effect portion 5*a* to the opening surface of the discharge port 10 preferably falls within a range from 3.0 μm to 5.0 μm. The length from the heat effect portion 5*a* to the substrate 1 preferably falls within a range from 2.0 μm to 4.0 μm.

At least part of a surface of the heat resistor layer 5 is covered with a covering layer 4 in the interior of the pressure chamber 11. The covering layer 4 extends from the interior of the pressure chamber 11 to a position coming into contact with a portion in which a side wall of the side wall member 7 is formed (hereinafter, referred to as the side wall). In this disclosure, with the configuration described above, the covering layer 4 is adhered sufficiently tightly to the side wall, and the side wall member 7 is prevented from being separated from the substrate 1 and the heat resistor layer 5. With the configuration in which the covering layer 4 is extended not only between the heat resistor layer 5 and the side wall member 7 but also from the interior of the pressure chamber 11, separation of the covering layer 4 itself is suppressed, whereby the separation of the side wall member 7 is suppressed. In particular, when the covering layer 4 is used as a cavitation resistant layer, the covering layer 4 is preferably extended in this manner.

Examples of the material that forms the covering layer 4 include Ta and Ir, for example. These material have high adhesiveness with respect to the side wall. In particular, in the case where the side wall is formed of inorganic material such as SiC, SiN, SiCN, $SiO_2$, and Oxynitride, adhesiveness between the side wall and Ta or Ir is high. FIG. 1B is an enlarged view illustrating the covering layer 4 in contact with the side wall. As illustrated in FIG. 1B, the surface of the heat resistor layer 5 is covered with the covering layer 4, and the covering layer 4 and the side wall of the side wall member 7 is in contact with each other at a portion where the heat resistor layer 5 at an end portion of the pressure chamber 11 is bent toward the substrate 1 (step portion). In this manner, the separation of the side wall member 7 is suppressed by keeping the covering layer 4 in contact with the side wall member 7. In particular, when the covering layer 4 is formed of SiN and the side wall member 7 is formed of Ta or Ir, the separation is desirably suppressed.

The covering layer 4 is preferably extended to a position in contact with the side wall by being extended continuously from the interior of the pressure chamber 11. The covering layer 4 preferably extends to a substrate side along the side wall as is and extends further in a direction parallel to the surface of the substrate. Preferably, the heat resistor layer 5 is formed as described above, and the covering layer 4 is extended along the heat resistor layer 5.

Figure 2A:
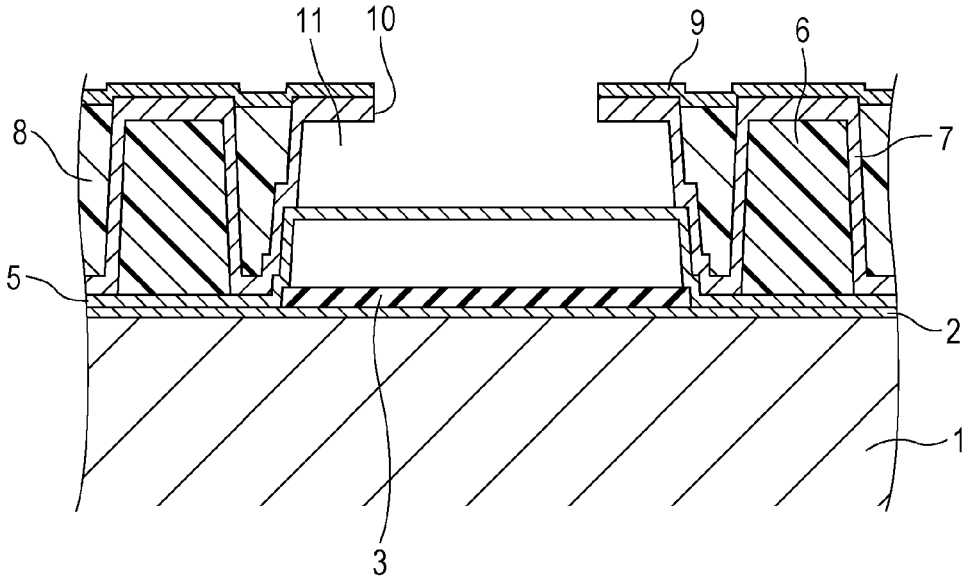
FIGS. 2A and 2B are drawings illustrating an example of a liquid discharge head of the related art.
Figure 2B:
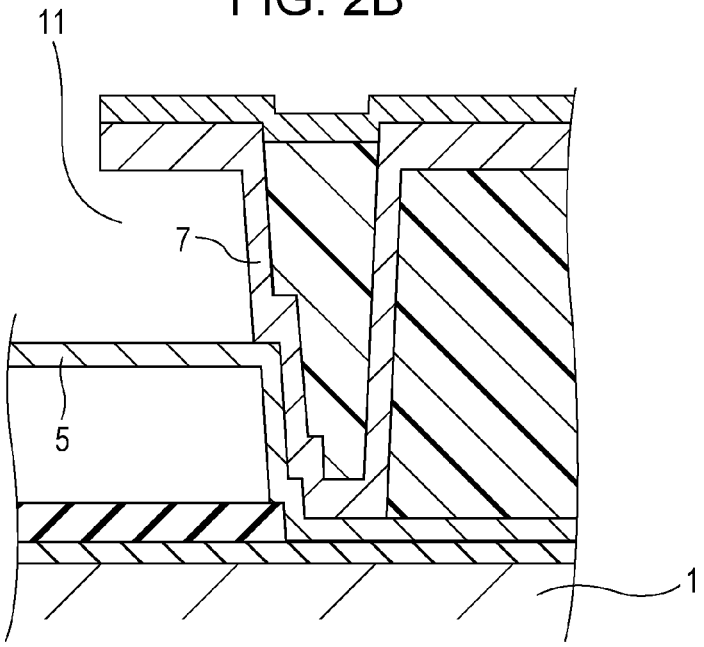

In contrast, in the liquid discharge head in FIG. 2A, the surface of the heat resistor layer 5 is not covered with the covering layer 4. The step portion of the heat resistor layer 5 is illustrated in FIG. 2B in an enlarged scale. In FIGS. 2A and 2B, since the covering layer 4 is not present, the heat resistor layer 5 is in contact with the side wall. For example, in the case where the heat resistor layer 5 is formed of Al, and is in contact with SiN which forms the side wall, separation may occur therebetween.

In this disclosure, the covering layer 4 may be used as a cavitation resistant layer of the heat resistor layer 5. An impact of defoaming is applied to the heat effect portion 5*a*. This is so-called cavitation and the heat effect portion 5*a*, that is, the heat resistor layer 5 may become damaged. In contrast, with the presence of the covering layer 4, an influence of the cavitation on the heat resistor layer 5 is suppressed. The covering layer 4 as described above may be formed of Ta preferably. Alternatively, a configuration having a plurality of layers formed of Ta and Ir is also applicable.

In FIGS. 1A and 1B, the covering layer 4 is formed on both surfaces of the heat resistor layer 5, namely, on a surface on the discharge port 10 side (front surface) and on a surface on the substrate 1 side (back surface). However, the covering layer 4 may have a configuration which covers the surface of the heat resistor layer 5 on the discharge port side and does not cover the surface on the substrate side. Alternatively, a configuration in which the surface of the heat resistor layer 5 on the discharge port side is not covered, and the surface on the substrate side is covered is also possible. In the case of the configuration in which the surface of the heat resistor layer 5 on the discharge port side is not covered, by the surface on the substrate side is covered, the side wall member 7 is arranged on the surface of the heat resistor layer 5 on the discharge port side, that is, on a lower side. The covering layer 4 preferably covers both surfaces of the heat resistor layer 5, namely, the surface on the discharge port side and the surface on the substrate side. At this time, the side surface of the heat resistor layer 5 (a surface connecting the surface on the discharge port side and the surface on the substrate side) may be or may not be covered.

The thickness of the covering layer 4 which is in contact with one surface of the heat resistor layer 5 preferably falls within a range from 0.1 μm to 1.0 μm, and more preferably, 0.2 μm or larger. The thickness of the covering layer 4 which is in contact with one surface of the heat resistor layer 5 is 0.7 μm or smaller.

In the case where the both surfaces of the heat resistor layer 5 are covered with the covering layers 4, the thickness of the covering layer 4 on the front surface side of the heat resistor layer 5 is preferably equal to or larger than the thickness of the covering layer 4 on the back surface side of the heat resistor layer 5. With this relationship of the thickness, the resistance characteristics against the cavitation or the adhesiveness between the heat resistor layer 5 and the side walls may be improved. The difference of the thickness is preferably 0.1 μm or larger, and more preferably, 0.2 μm or larger. In the case where the side surface of the heat resistor layer 5 is covered from the reason of manufacture, the thickness of the portion that covers the side surface is preferably the same as or similar to the thickness thereof on the front surface side with a difference not more than 0.1 μm.

It is preferable that the covering layer 4 and the side wall member 7 are in contact at a portion where the covering layer 4 covers the step portion of the heat resistor layer 5, that is, at a portion of 5*b* in FIG. 1A for suppressing separation of the side wall member 7.

Subsequently, a method of manufacturing the liquid discharge head of this disclosure will be described with reference to FIGS. 3A to 3M.

Figure 3A:
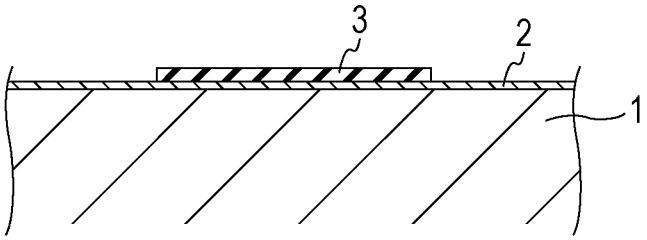
FIGS. 3A to 3M are drawings illustrating a method of manufacturing the liquid discharge head of this disclosure.
Figure 3B:
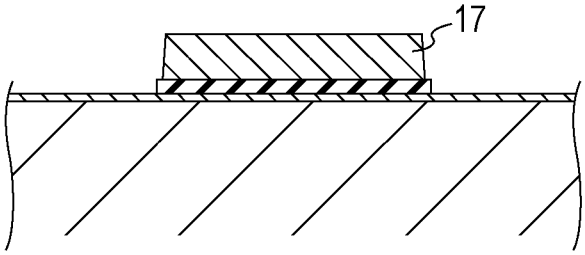

As illustrated in FIG. 3A, a substrate 1 having a wiring 2 and an insulation layer 3 on the surface thereof is prepared. The substrate 1 is also provided with a CMOS drive transistor (not illustrated) thereon. The wiring 2 and the insulation layer 3 are formed by a spattering method or a CVD method.

Subsequently, a resist is applied on the surfaces of the wiring 2 and the insulation layer 3 on the CMOS drive transistor by spin coating. Subsequently, a flattening is performed and in addition, exposure and patterning are performed. In this manner, a first die material 17, which is part of the die material of the pressure chamber is formed on the surface of the substrate 1 illustrated in FIG. 3B. The thickness of the first die material 17 preferably falls within a range from 1.0 μm to 5.0 μm. Examples of the resist include a photosensitive resin. The first die material 17 may be formed of a metal.

Figure 3C:
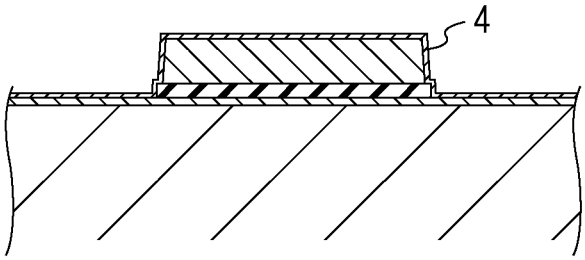

Subsequently, as illustrated in FIG. 3C, the covering layer 4 (hereinafter, referred to also as a "first covering layer") is formed so as to cover the first die material 17. The first covering layer 4 is formed by applying a material of the first covering layer 4 by spattering and performing patterning thereon. The first covering layer 4 formed here covers the back surface of the heat resistor layer (the surface of the heat resistor layer on the substrate 1 side).

Figure 3D:
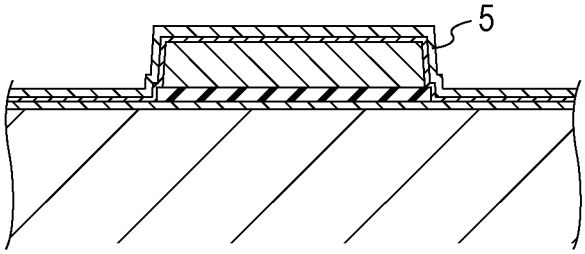

Subsequently, as illustrated in FIG. 3D, the heat resistor layer 5 is formed so as to cover the first covering layer 4. The wiring for heating the heat resistor layer 5 is also formed. These are formed by the CVD method or the patterning.

Figure 3E:
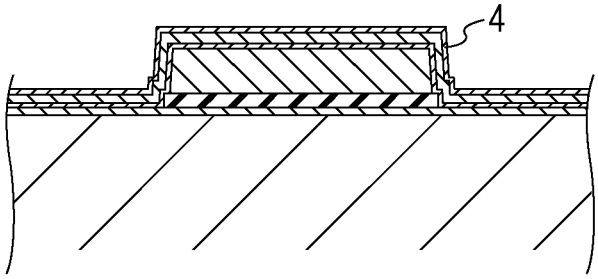

Subsequently, as illustrated in FIG. 3E, the covering layer 4 (hereinafter, referred to also as a "second covering layer") is formed by spattering or patterning so as to cover the front surface of the heat resistor layer 5. The second covering layer 4 in this case may be formed of the same material as that of the first covering layer 4 described in conjunction with FIG. 3C, or may be formed of a different material. In this manner, the both surfaces of the heat resistor layer 5 are covered with the first and second covering layers 4. In the case where the back surface side is not covered, a process in FIG. 3C needs to be performed.

Figure 3F:
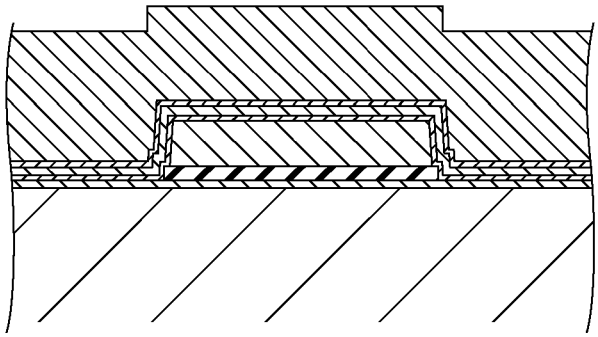
Figure 3G:
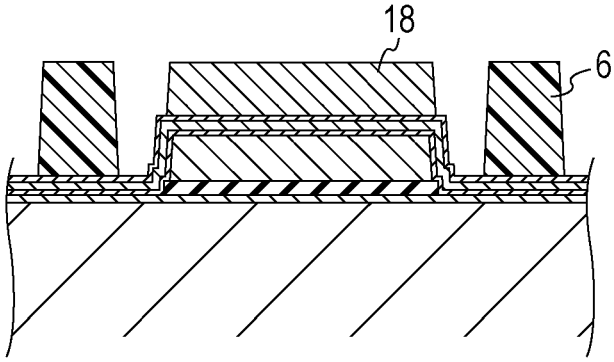

Subsequently, the resist is applied as illustrated in FIG. 3F, and patterning is performed as illustrated in FIG. 3G. Accordingly, part corresponding to the filling material 6 and a second die material 18 as part of the die material of the pressure chamber are formed on the second covering layer 4. Examples of the resist include a photosensitive resin. The second die material 18 may be formed of a metal. The first die material 17 and the second die material 18 may be formed of the same material or may be formed of different materials.

Figure 3H:
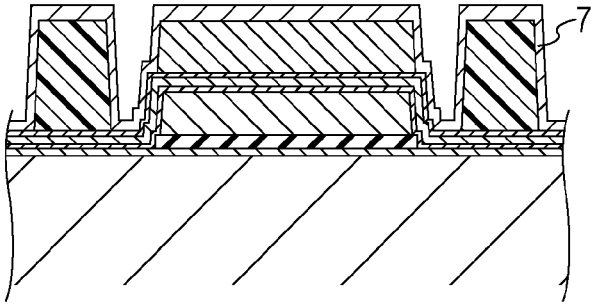
Figure 3I:
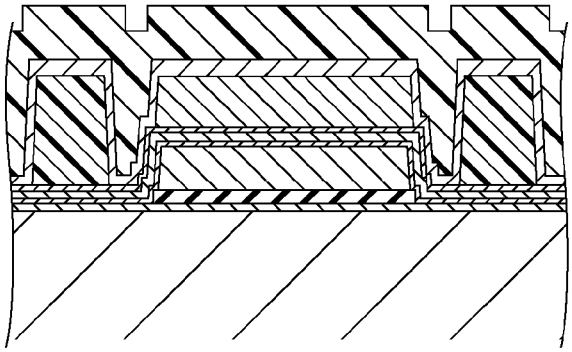
Figure 3J:
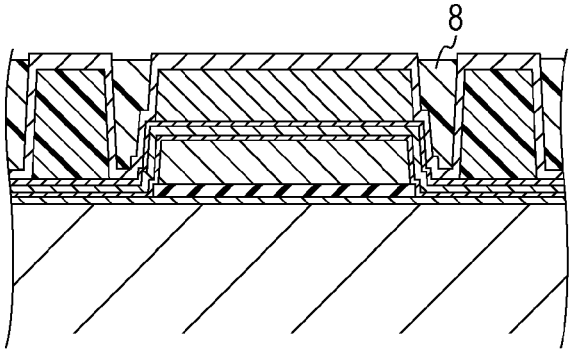

Subsequently, as illustrated in FIG. 3H, the side wall member 7 is formed by the CVD method and the patterning so as to cover the filling material 6 and the second die material 18. The side wall member 7 is brought into contact with the second covering layer 4. Subsequently, the resist or the like is applied and flattened by spin coating or the like as illustrated in FIG. 3I, the filling material 8 is formed as illustrated in FIG. 3J.

Figure 3K:
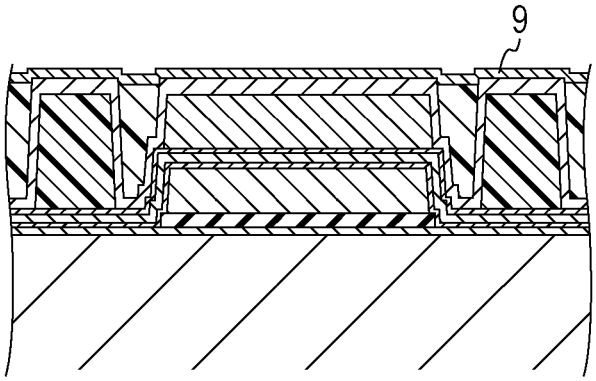
Figure 3L:
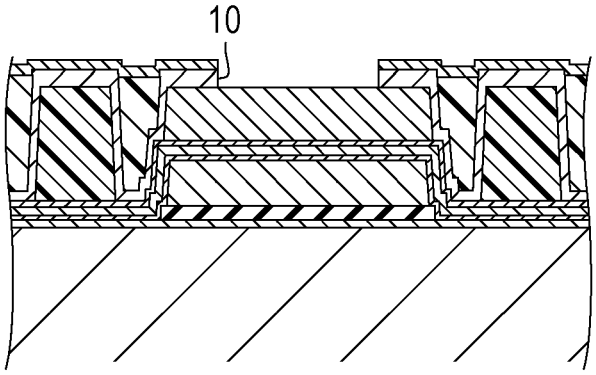

As a next step, as illustrated in FIG. 3K, a surface protecting layer 9 is formed by the CVD method or the like so as to cover the filling material 8. Subsequently, the patterning is performed on the surface protecting layer 9 and the side wall member 7, and as illustrated in FIG. 3L, a discharge port 10 is formed.

Figure 3M:
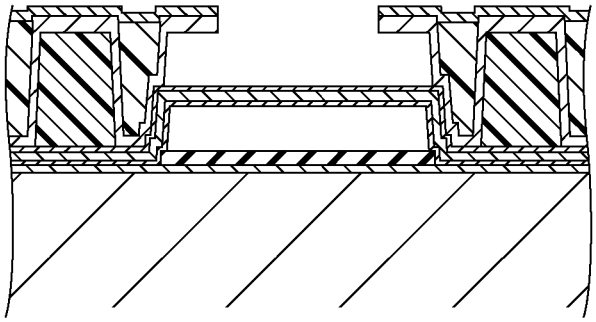

Finally, the first die material 17 and the second die material 18 are removed by solvent or the like, and the liquid discharge head is manufactured as illustrated in FIG. 3M. In FIG. 3M, a supply port is not formed in the substrate 1. However, the supply port may be formed after a state illustrated in FIG. 3M and, for example, the supply port may be formed before the state of FIG. 3A and infilled once, and then formed again by removing the filling material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-111647, filed in May 29, 2014, which is hereby incorporated by reference herein in its entirety.

What is claimed is:

1. A liquid discharge head comprising:

a substrate;

a heat resistor layer; and a side wall member that forms a side wall of a pressure chamber, the heat resistor layer having a heat effect portion configured to foam liquid in an interior of the pressure chamber to discharge the liquid from a discharge port, wherein the heat effect portion is apart from the substrate, and at least part of a surface of the heat resistor layer is covered with a covering layer in the interior of the pressure chamber, and at least part of opposite side of the covering layer contacts the side wall of the side wall member.

2. The liquid discharge head according to claim 1, wherein the covering layer is formed of at least one of Ta or Ir.

3. The liquid discharge head according to claim 1, wherein the side wall member is formed of at least one of SiC, SiN, SiCN, $SiO_2$, and Oxynitride.

4. The liquid discharge head according to claim 1, wherein the covering layer covers a surface of the heat resistor layer on the discharge port side.

5. The liquid discharge head according to claim 1, wherein the covering layer covers a surface of the heat resistor layer on the substrate side.

6. The liquid discharge head according to claim 1, wherein the covering layer covers surfaces of the heat resistor layer on the discharge port side and on the substrate side.

7. The liquid discharge head according to claim 6, wherein a thickness of the covering layer which covers the surface of the heat resistor layer on the discharge port side is equal to or larger than a thickness of the covering layer which covers the surface of the heat resistor layer on the substrate side.

8. The liquid discharge head according to claim 1, wherein the covering layer and the side wall member are in contact with each other at a portion where the covering layer covers a step portion of the heat resistor layer.

9. The liquid discharge head according to claim 1, wherein the covering layer is formed of Ta, and the side wall member is formed of SiN.

10. The liquid discharge head according to claim 1, wherein the covering layer is formed of Ir, and the side wall member is formed of SiN.

11. The liquid discharge head according to claim 1, wherein the thickness of the covering layer which is in contact with one surface of the heat resistor layer falls within a range from 0.1 μm to 1.0 μm.

12. The liquid discharge head according to claim 1, wherein the thickness of the side wall member falls within a range from 1.0 μm to 5.0 μm.

13. The liquid discharge head according to claim 1, wherein the thickness of the side wall member falls within a range from 2.0 μm to 3.0 μm.

14. The liquid discharge head according to claim 1, wherein the thickness of the heat resistor layer falls within a range from 0.1 μm to 1.0 μm.

15. The liquid discharge head according to claim 1, wherein the thickness of the heat resistor layer falls within a range from 0.2 μm to 0.8 μm.

16. A method of manufacturing a liquid discharge head including: a substrate; a heat resistor layer; and a side wall member that forms a side wall of a pressure chamber, the heat resistor layer having a heat effect portion configured to foam liquid in an interior of the pressure chamber to discharge the liquid from a discharge port, wherein the heat effect portion is apart from the substrate, at least part of a surface of the heat resistor layer is covered with a covering layer in the interior of the pressure chamber, and at least part of opposite side of the covering layer contacts the side wall of the side wall member, comprising:

forming a first die material on a surface of the substrate;

forming the heat resistor layer so as to cover the surface of the substrate and the first die material;

forming a covering layer so as to cover the surface of the heat resistor layer;

forming a second die material on the covering layer;

forming the side wall member so as to cover the second die material and come into contact with the covering layer; and removing the first die material and the second die material to form the pressure chamber.

17. The method of manufacturing the liquid discharge head according to claim 16, wherein the covering layer is formed of at least one of Ta or Ir.

18. The method of manufacturing the liquid discharge head according to claim 16, wherein the side wall member is formed of at least one of SiC, SiN, SiCN, $SiO_2$, and Oxynitride.

19. A method of manufacturing a liquid discharge head including:

a substrate; a heat resistor layer; and a side wall member that forms a side wall of a pressure chamber, the heat resistor layer having a heat effect portion configured to foam liquid in an interior of the pressure chamber to discharge the liquid from a discharge port, wherein the heat effect portion is apart from the substrate, at least part of a surface of the heat resistor layer is covered with a second covering layer in the interior of the pressure chamber, and at least part of opposite side of the second covering layer contacts the side wall of the side wall member, comprising:

forming a first die material on a surface of the substrate;

forming a first covering layer so as to cover the surface of the substrate and the first die material;

forming a heat resistor layer so as to cover the first covering layer;

forming the second covering layer so as to cover the surface of the heat resistor layer;

forming a second die material on the second covering layer that covers the surface of the heat resistor layer;

forming the side wall member so as to cover the second die material and come into contact with the second covering layer which covers the surface of the heat resistor layer; and removing the first die material and the second die material to form the pressure chamber.

20. The method of manufacturing the liquid discharge head according to claim 19, wherein the first covering layer and the second covering layer are formed of at least one of Ta or Ir, and the side wall member is formed of at least one of SiC, SiN, SiCN, $SiO_2$, and Oxynitride.

* * * * *